US005381899A

United States Patent [19]

Rabbitt

[11] Patent Number: 5,381,899

[45] Date of Patent: Jan. 17, 1995

[54] PACKAGE ASSEMBLY FOR DECORATIVE LIGHTS

[76] Inventor: Mary M. Rabbitt, 634 Via Lido Nord, Newport Beach, Calif. 92663

[21] Appl. No.: 204,484

[22] Filed: Mar. 2, 1994

[51] Int. Cl.[6] ..... B65D 85/42

[52] U.S. Cl. ..... 206/397; 206/408; 206/419

[58] Field of Search ..... 206/418–421, 206/397, 408

[56] References Cited

U.S. PATENT DOCUMENTS

| | | | |
|---|---|---|---|
| 4,917,323 | 4/1990 | Wing | 206/419 |
| 5,033,619 | 7/1991 | Garis | 206/420 |
| 5,123,534 | 6/1992 | Chwang | 206/419 |
| 5,168,999 | 12/1992 | Lee et al. | 206/420 |
| 5,222,602 | 6/1993 | Liao | 206/420 |
| 5,287,965 | 2/1994 | Miller | 206/420 |
| 5,317,491 | 5/1994 | Lee | 206/420 |

*Primary Examiner*—Jimmy G. Foster
*Attorney, Agent, or Firm*—William H. Drummond

[57] ABSTRACT

A package for decorative lights includes an elongate hollow cylindrical core with notches in the ends of the core. The decorative light string is wound around the exterior of the core with the terminal ends of the string extending through the notches, securing the cord around the core, with the electrical connector plugs on the terminal ends enclosed within the core. A protective outer cover encloses the core and the light string wound on the core. Preferably the outer cover has a polygonal cross-section and the electric lights on the string are received in and protectively enclosed by the inner apexes of the cover.

2 Claims, 2 Drawing Sheets

PACKAGE ASSEMBLY FOR DECORATIVE LIGHTS

This invention relates to a package assembly for decorative lights.

More particular, the invention concerns a package assembly for shipping and displaying decorative light strings for sale, which is specially adapted for convenient re-use by the customer, to repackage the light string after use and to store the light string until the next occasion for use.

In yet another respect, the invention pertains to a package for decorative lights which is specially configured to protect the fragile electric lights, without requiring complicated package construction, and which simplifies removal and re-storing the light string.

Decorative light strings generally comprise an elongate electrical conductor-pair cord, with a plurality of electric lights connected at spaced points along the cord. Electrical plugs are typically connected at the terminal ends of the cord to effect electrical connection of the light string to a source of electrical power, e.g., a conventional household convenience outlet and/or to another such light string. Each electrical light connected along the cord typically includes a light bulb base and a replaceable light bulb engaged in the base. Because of inexpensive construction, the connection of the base to the cord and the fragile light bulbs themselves require protective packaging to prevent damage during shipping and display of the decorative light string, prior to sale to the end user. For example, a conventional package system for such light strings is illustrated in the U.S. Pat. No. 5,168,999 to Lee et al.

Once the end user removes the light string from the display package, however, it is very inconvenient and time consuming to re-stow the light string in the original packaging for storage between uses. Consequently, various organizers or carriers have been proposed for re-stowing and storing decorative light strings between uses. For example, the U.S. Pat. No. 4,064,067 to McAllister, et al. discloses a generally rectangular, planar frame and the U.S. Pat. No. 5,033,619 to Garis discloses a flat lattice, upon which the light string is wound and a cover carrier for the lattice.

Another packaging system for strings of much larger light bulbs, e.g., for lighting construction areas, etc. is disclosed in the U.S. Pat. No. 3,931,887 to Beck, consisting of a cylindrical structure with notches formed therein to receive the electrical cord and permit positioning of the individual light bulbs and protective cages inside the storage cylinder.

A package for shipping and storing a detonator cord assembly terminating in a blasting cap is disclosed in U.S. Pat. No. 1,631,756 to Olin. The detonator cable is wrapped around the exterior of a hollow cylinder which protectively encloses the blasting cap.

The principal object of the present invention is to provide a convenient, relatively inexpensive package for shipping, displaying and storing decorative light strings.

Another object of the invention is to provide such a packaging system which is of simplified construction and which may be conveniently re-used to quickly restow the light set and protect the fragile components thereof during handling and storage between uses.

Thus, these and other, further and more specific objects and advantages of the invention will be apparent to those skilled in the art from the following detailed description thereof, taken in conjunction with the drawings in which.

Briefly, in accordance with the invention, I provide a package assembly for shipping, displaying and storing a string of decorative lights. The decorative lighting string typically includes an electrical conductor-pair cord having terminal ends. An electrical contactor plug is provided on each of the terminal ends, for electrically connecting the conductor-pair to an electrical convenience outlet or to another such string. The decorative light string includes a plurality of electrical lights connected to the conductor-pair and spaced along the length thereof. My package assembly comprises an inner elongate hollow generally cylindrical core and a decorative light string wrapped around and upon the exterior surface of the core. The outer protective cover encloses the core with the light string wound thereon. The inner core has opposed ends and notches, formed in the wall thereof, at the opposed ends. The notches extend longitudinally from each opposed end toward the center of the core. The terminal ends of the decorative light string extend through the notches to secure the string upon and around the core and to select the terminal ends of the strings and the electrical connector plugs within the core.

In the presently preferred embodiment, the diameter of the core and the spacing of the lights on the connector-pair are selected to locate the lights generally along angular-spaced longitudinal rows on the core when the cord is wrapped around the core. The protective outer cover is formed with a polygonal cross-section, forming inner apexes which receive and protectively enclose rows of the lights which are angularly spaced on the core.

Figure 1:
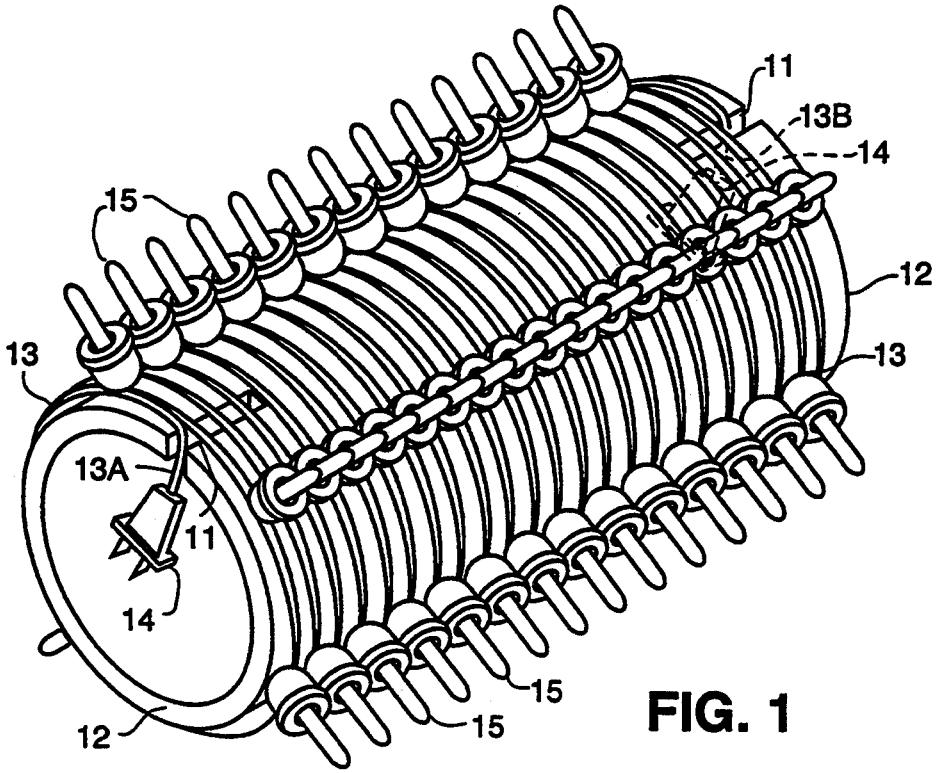
FIG. 1 is a perspective view of the packaging assembly of the invention, according to one embodiment thereof.
Figure 4:
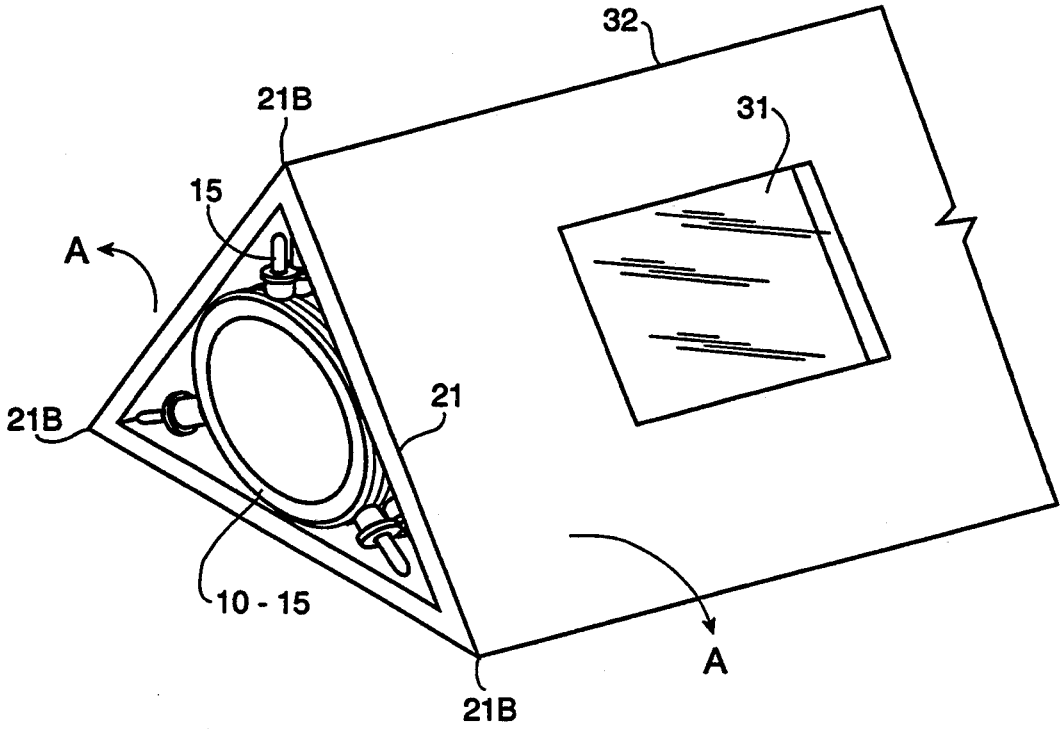
FIG. 4 is an end view which depicts the presently preferred embodiment of the invention.

Turning now to the drawings, which are provided in order to enable those skilled in the art to understand and practice my invention, but which are not intended as limitations on the scope of the invention, FIG. 1 depicts a cylindrical core 10 with notches 11 formed in opposed ends 12 of the core 10. The electrical cord 12 of the decorative light string is wrapped around the exterior surface of the core 10 with the terminal ends **13*a* and 13*b* of the cord 13 extending through the notches 11 in the interior of the core 10. The electrical plugs 14 on the ends 13*a* and 13*b* of the cord 13 are thus positioned within the core 10. Electric lights 15 are aligned in angularly spaced rows projecting outwardly from the outer surface of the core 10. The angular separation of the rows of lights 15 is determined by the spacing between the lights 15 on the cord 13 and the outer diameter of the core 10. For example, if the lights are spaced 12 inches apart on the cord and the outer diameter of the core is about 1.27 inches, then the lights 15 will be aligned in rows which are angularly spaced 120° apart as shown in FIG. 4**. Other angular spacings can be selected by those skilled in the art from other combinations of light spacing on the cord and core outer diameter.

Figure 2:
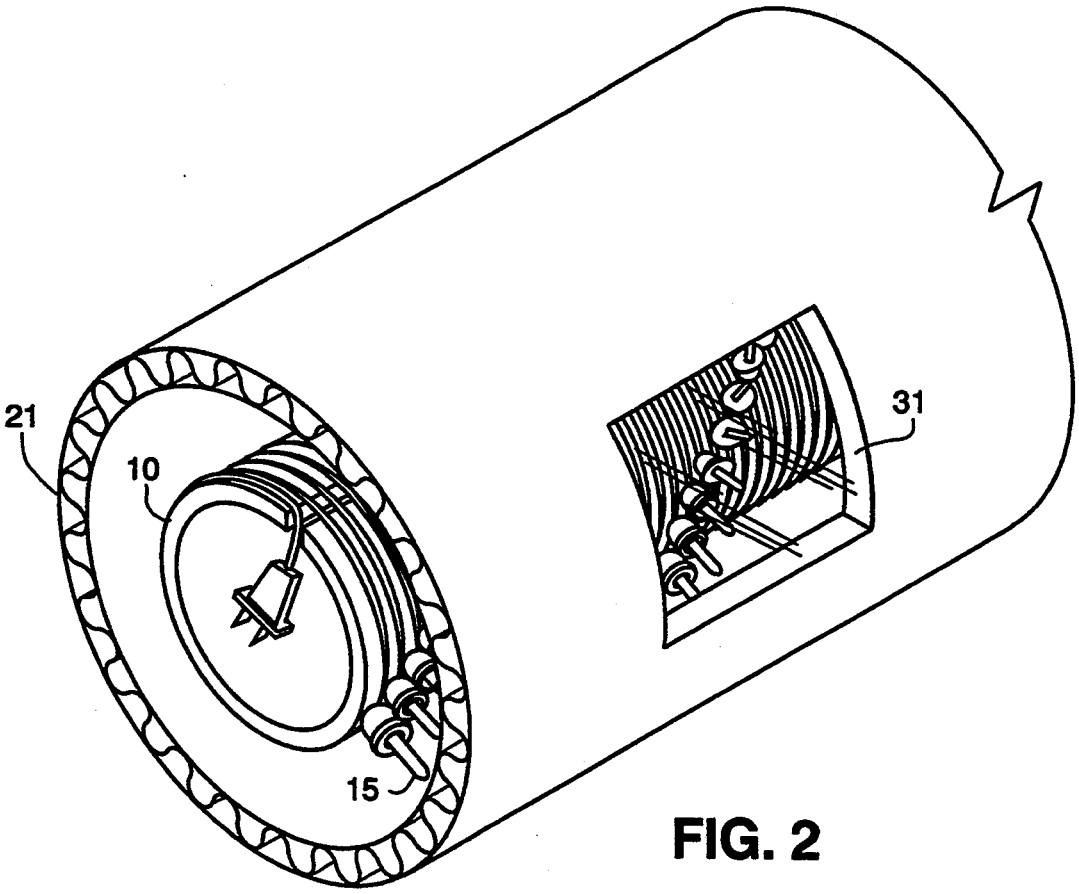
FIG. 2 is an end view of the assembly of FIG. 1.
Figure 3:
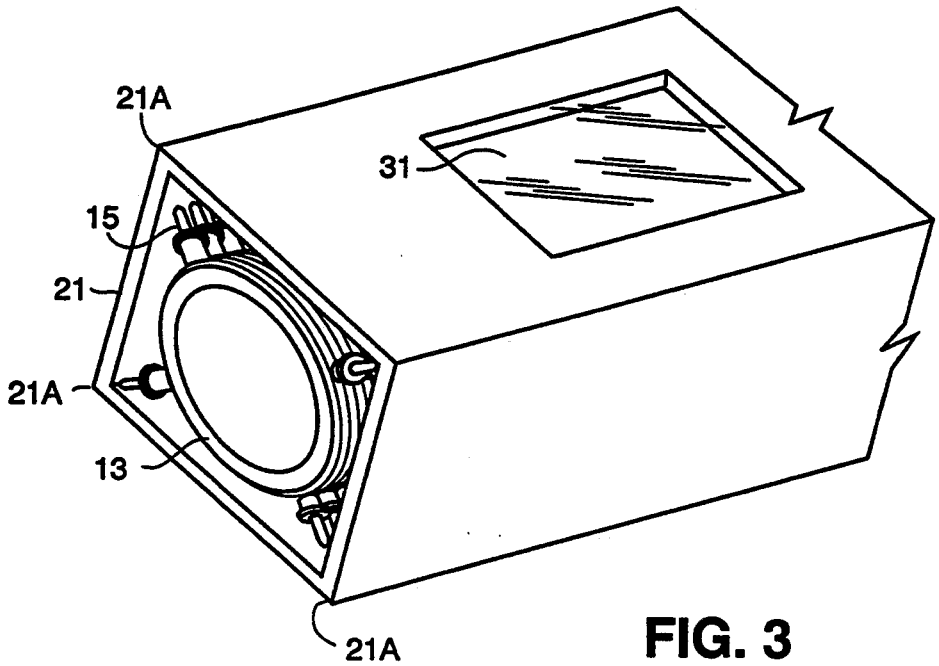
FIG. 3 is an end view depicting an alternate embodiment of the invention.

FIGS. 2, 3 and 4 illustrate various embodiments of the invention in which the outer protective cover 21 is configured to have different cross-sections, generally circular (FIG. 2), square (FIG. 3) and triangular (FIG. 4).

For example, as depicted in FIG. 2, the outer protective cover 21 is cylindrically shaped and formed, for example, of corrugated cardboard to provide mechanical protection for the lights 15 wound on the inner core 10 which is concentrically received within the outer protective cover 21.

As depicted in FIG. 3, the outer protective cover 21 can be formed of foamed plastic. The lights 15 on the cord 13 extend outwardly toward the corners 21*a* of the cover 21.

Similarly, if the rows of lights 15 are angularly spaced 120° apart, the cover 21 is formed with a triangular cross-section, each of the apexes 21*b* receive and protectively enclose one of the rows of lights 15.

If desired, inspection windows 31 can be formed in the side walls of the outer protective covers 12, to facilitate viewing of the decorative light strings by a prospective customer.

As will be apparent to those skilled in the art, the outer protective covers 21 can be formed as a single piece element and the inner core 10 with the light string wrapped thereon, can be received within the outer covers 21 by sliding engagement between these elements. Alternatively, the outer cover 21 can be formed with a longitudinal seam, which permits the outer cover 21 to be opened laterally for removal or replacement of the contents. In a particularly preferred embodiment, the outer covers 21 are formed on a deformable foamed plastic material which permits the walls to be temporarily spread apart. The longitudinal seam 32, formed in the edge of the polygonal cross-section cover 21, permits the cover to be separated by movement in the direction of the arrows A to permit removal and restowing of the contents 10–15.

Having described my invention in such terms as to enable those skilled in the art to make and use it and, having identified the presently preferred best mode thereof,

I claim:

1. A package assembly for shipping, displaying and storing a string of decorative lights, said decorative light string including an electrical conductor-pair cord having terminal ends, plug means on said terminal ends for electrically connecting said conductor-pair to an electrical convenience outlet or to another such string, and a plurality of electrical lights connected to said conductor-pair, spaced along the length thereof, said package assembly comprising:

a) an inner elongate, hollow, generally cylindrical core, having opposed ends and notches, formed in the wall thereof at said opposed ends and extending longitudinally toward the center thereof;

b) said decorative light string wound around arid upon the exterior surface of said cylindrical core, the terminal ends of said string extending through said notches to secure said string upon and around said core and to locate said terminal ends and plug means within said core; and c) an outer protective cover, enclosing said core with said light string wound thereon.

2. The package assembly of claim 1, wherein, a) the diameter of said core and spacing of said lights on said conductor-pair are selected to locate said lights generally along angularly-spaced longitudinal rows on said core; and b) said outer protective cover is formed with a polygonal cross-section, the internal apexes of which receive and protectively enclose said rows of lights angularly spaced on said core.

* * * * *